US009702099B2

(12) United States Patent
Rust et al.

(10) Patent No.: US 9,702,099 B2
(45) Date of Patent: Jul. 11, 2017

(54) PORTABLE A-FRAME BARRIER AND DISPLAY PANEL

(71) Applicants: Melissa Ann Rust, Choctaw, OK (US); Vernon Michael Kanaly, Oklahoma City, OK (US)

(72) Inventors: Melissa Ann Rust, Choctaw, OK (US); Vernon Michael Kanaly, Oklahoma City, OK (US)

(73) Assignee: Walker Stamp & Seal Co., Oklahoma City, OK (US)

( * ) Notice: Subject to any disclaimer, the term of this patent is extended or adjusted under 35 U.S.C. 154(b) by 28 days.

(21) Appl. No.: 14/635,630

(22) Filed: Mar. 2, 2015

(65) Prior Publication Data

US 2015/0275446 A1 Oct. 1, 2015

Related U.S. Application Data

(60) Provisional application No. 61/946,836, filed on Mar. 2, 2014.

(51) Int. Cl.

| | |
|---|---|
| ***E04H 17/16*** | (2006.01) |
| ***E01F 13/02*** | (2006.01) |
| ***G09F 7/00*** | (2006.01) |
| ***G09F 7/18*** | (2006.01) |
| ***G09F 15/00*** | (2006.01) |
| ***G09F 23/00*** | (2006.01) |
| ***G09F 1/06*** | (2006.01) |

(52) U.S. Cl.

CPC ..... *E01F 13/022* (2013.01); *G09F 1/065* (2013.01); *G09F 7/00* (2013.01); *G09F 7/18* (2013.01); *G09F 15/0062* (2013.01); *G09F 23/00* (2013.01)

(58) Field of Classification Search

CPC ..... E01F 13/022; E01F 13/02; G09F 1/065; G09F 7/00; G09F 15/0062; G09F 23/00; E02B 3/10; E02B 3/106; B60Q 7/005

USPC .... 256/24, 26; 40/604, 606.15, 606.18, 610; 404/6, 9; 405/107, 114, 116; 116/63 P, 116/63 T

See application file for complete search history.

(56) References Cited

U.S. PATENT DOCUMENTS 1,112,064 A * 9/1914 Gordon ..... A01M 1/02 43/114
1,928,806 A * 10/1933 Barcalo ..... A47G 9/1045 248/441.1
2,881,662 A 4/1959 Harris
(Continued)

*Primary Examiner* — Gregory Binda
*Assistant Examiner* — Nahid Amiri
(74) *Attorney, Agent, or Firm* — Kammer Browning PLLC

(57) ABSTRACT

A portable, foldable, self-standing A-frame barrier and display panel, preferably made up of a single sheet of corrugated material scored and folded along a number of parallel lines to create multiple upright panel sections. When folded to form the A-frame structure, the device is capable of serving as both an upright barrier and a display board. Two side panel sections meet along an apex edge that preferably incorporates retractable handles. Two base panel half sections are folded so as to have their edges meet in the formation of a base support. Elastic cord assemblies are incorporated into the base sections to draw the sections together and to facilitate retention of the A-frame in an upright configuration. Hook ends on the elastic cord assemblies facilitate retention of the A-frame in position on a flat surface.

6 Claims, 4 Drawing Sheets

(56) References Cited

U.S. PATENT DOCUMENTS 3,371,815 A * 3/1968 Macomber ..... B65D 9/20 206/597
3,428,235 A * 2/1969 Randazzo ..... B65D 71/36 206/427
4,244,134 A * 1/1981 Otterson ..... A01M 23/005 43/114
4,279,105 A 7/1981 Cameron
4,298,186 A 11/1981 Glass
4,425,731 A * 1/1984 Orlando ..... A01M 23/005 229/115
4,709,718 A * 12/1987 Nichols ..... E04H 15/40 135/115
4,738,049 A * 4/1988 Baley ..... A01M 1/02 43/122
4,856,652 A * 8/1989 Bowland ..... B65D 71/00 184/1.5
4,928,415 A 5/1990 Walters
4,999,937 A 3/1991 Bechtold
5,382,112 A 1/1995 Fu
5,396,729 A * 3/1995 Vejvoda ..... A01M 1/02 43/114
5,544,614 A 8/1996 Cushman
5,887,373 A 3/1999 Byers
6,164,870 A * 12/2000 Baruh ..... E02B 3/108 405/114
6,393,748 B1 5/2002 Cooper
6,615,523 B1 9/2003 Curbelo et al.
6,651,367 B1 * 11/2003 Barragan ..... G09F 7/18 116/63 P
6,672,799 B2 * 1/2004 Earl ..... E02B 3/108 404/6
6,996,929 B1 2/2006 Greene, Jr. et al.
7,047,681 B2 5/2006 Perelli et al.
7,325,345 B2 * 2/2008 Hailo ..... G09F 15/0062 116/63 P
7,562,477 B2 7/2009 Kurple et al.
7,708,495 B1 * 5/2010 Antee ..... E02B 3/108 405/111
7,823,526 B2 * 11/2010 Julnes ..... G09F 13/16 116/63 C
7,886,467 B2 2/2011 Glass
8,302,551 B2 * 11/2012 Julnes ..... G09F 1/06 116/63 C
8,388,024 B2 * 3/2013 Mehta ..... B42D 15/045 229/92.8
8,793,927 B2 * 8/2014 Winkler ..... A01M 1/02 43/107
2014/0199118 A1 * 7/2014 Wersching ..... E01F 13/12 404/6

* cited by examiner

PORTABLE A-FRAME BARRIER AND DISPLAY PANEL

CROSS REFERENCES TO RELATED APPLICATIONS

This application claims the benefit under Title 35 United States Code §119(e) of U.S. Provisional Application 61/946,836, filed Mar. 2, 2014, the full disclosure of which is incorporated herein by reference.

BACKGROUND OF THE INVENTION

1. Field of the Invention

The present invention relates generally to portable signs and barriers incorporating informational and/or advertising display panels. The present invention relates more specifically to a portable, foldable, self-standing A-frame barrier and display panel used for sectioning off an area and for advertising or presenting information to the public.

2. Description of the Related Art

Efforts have been made in the past to provide portable barriers designed to section off areas and to generally control the movement of individuals and groups within a defined space. Efforts have also been made to incorporate advertising and\or promotional materials on such barriers. Of the few systems of this nature that are available, and which provide barriers and printed graphics (such as sponsor graphics used at events), most are not structured to provide both durability and portability at the same time. Those devices that do provide some level of durability and ruggedness are generally constructed with separate rigid frames onto which display panels are secured. This limits portability and increases cost. Those devices that provide portability and low cost are generally not as durable and tend to wear out quickly, unable to remain self-supporting for more than a few repeated uses.

It would be desirable to have a portable, foldable, self-standing A-frame barrier and display panel that could be used for sectioning off an area and for advertising or presenting information to the public. It would be desirable if such a device could be both durable and portable. It would be desirable if such an A-frame barrier could be easily manufactured at a low cost. Such an A-frame barrier would preferably be easy to set-up and take-down and would be light enough to be carried by one or two people. It would be desirable for such a product to be easily moved into position and set up as well as collapsed and moved to a storage location. It would be preferable that such a device could be used in conjunction with many additional similar devices that might be placed end to end to provide a larger barrier and advertising display. It would be desirable for such a product to incorporate elements that facilitate the set-up of the panel and assist in the retention of the panel/barrier upright in its display condition and position on a flat surface.

SUMMARY OF THE INVENTION

In fulfillment of the above and further objectives the present invention provides a portable, foldable, self-standing A-frame barrier and display panel that is made up of a single sheet of corrugated material that is scored and folded along a number of parallel lines to create four panel sections that, when folded, form an A-frame structure suitable as a barrier and a display board. Two side panel sections meet along an apex edge that preferably incorporates retractable handles. Two base panel half sections are folded so as to have their edges meet in the formation of a base support. Elastic cord assemblies are incorporated into the base sections to draw the sections together and to facilitate retention of the A-frame structure in an upright condition.

A preferred embodiment of the present invention is constructed from a single 8'×8'×0.5" heavy duty corrugated plastic sheet. A number of elastic cord assemblies are incorporated into the base of the folded structure to facilitate its establishment and subsequent collapse. Hooks on the ends of the elastic cords may be used to secure the A-frame barrier in place on the ground or other flat surface. Display indicia may be printed directly on the upright display panels of the device or may be separately secured to the device using removable adhesion surfaces or the like. Multiple A-frame barriers may be used to create a longer barrier and may be collapsed and stacked to reduce storage volume. Other features and benefits of the device of the present invention are made clear from the attached drawing figures and the detailed description of the same that follows below.

DETAILED DESCRIPTION OF THE PREFERRED EMBODIMENTS

Among the goals of the present invention are structural strength and durability within an easily setup and readily portable A-frame barrier and display panel. While the display panel must be foldable in order to be portable, it is important that the structure, when assembled, is both strong and durable. As indicated above, the structure will be subjected to repeated foldings and unfoldings as the portable A-frame and display panel is repeatedly setup and taken down. Insofar as the structure of the present invention is intended to be self-standing, that is, it is not to include any separate internal frame structure, the material utilized to create the panels from which the structure is manufactured are preferably corrugated sheets of material. In the preferred embodiment of the present invention, such corrugated sheets are made up of plastic materials forming what is commonly known as corrugated plastic, an example of which is manufactured and marketed under the Coroplast® brand. Such material is available in a variety of sheet sizes that may be cut down and folded into a variety of configurations. In the present invention, the preferred material for construction of the A-frame barrier and display panel is an 8'×8'×0.5" heavy duty corrugated plastic sheet. Those skilled in the art, however, will recognize that other types of rigid or semi-rigid panels may serve as the construction material for the A-frame barrier and display panel of the present invention. Corrugated cardboard may serve the requirements of the present invention, although the durability of the same may be significantly reduced. In addition, those skilled in the art will recognize that a wide range of finished sizes are possible that all adhere to the basic construction design elements described herein.

Figure 1:
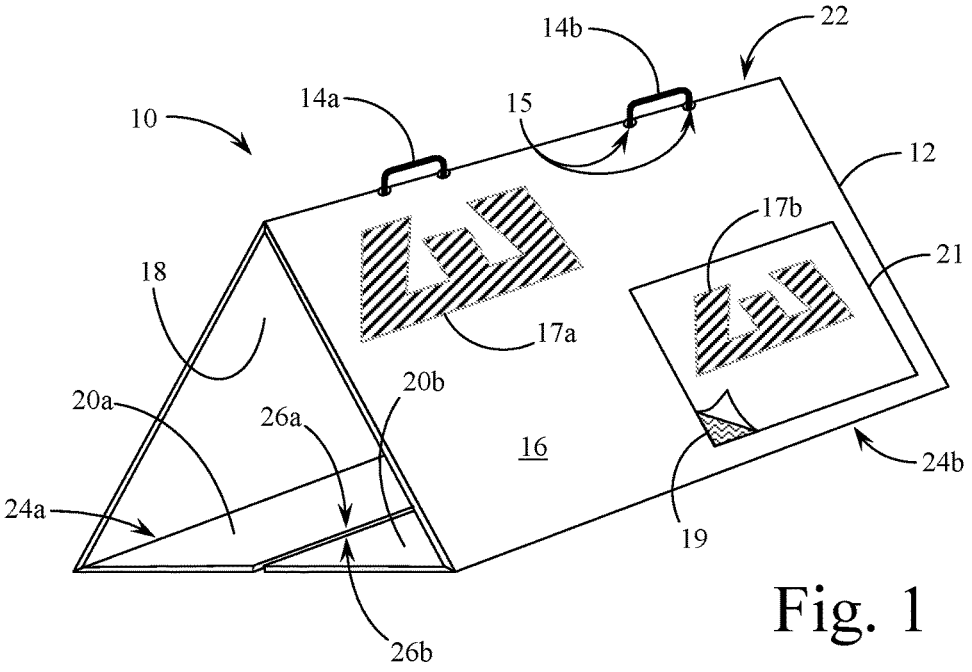
FIG. 1 is a perspective view of an assembled and established frame structure of the present invention.

Reference is made first to FIG. 1 which provides a perspective view of a fully assembled and established A-frame structure of the present invention. In this view, the panel is shown as it would appear in use before the public with various advertising indicia included. FIG. 1 shows self-standing signage frame 10 as being constructed of folded corrugated panel 12, made up of front side display panel 16, back side display panel 18, as well as base back panel 20*a* and front base panel 20*b*. Retractable handles 14*a* & 14*b* are shown slidingly positioned through apertures 15 on frame apex fold edge 22 between front side display panel 16 and back side display panel 18.

As described in more detail below, the structure of self-standing signage frame 10 is generally made up of a single panel of folded corrugated panel 12 that is scored, folded, and arranged into the A-frame structure shown in FIG. 1. A first fold is made along frame front base fold edge 24*b* with a second middle fold made at frame apex fold edge 22. A third fold is made at frame back base fold edge 24*a* and the outside (now internal) edges of the base, shown as back base panel edge 26*a* and front base panel edge 26*b*, are aligned and flexibly secured together (in a manner described in more detail below) to form the base of the A-frame structure.

In the fully established form as shown in FIG. 1, display indicia may be placed on front side display panel 16 as well as back side display panel 18. Multiple A-frames may be positioned and placed in line adjacent to each other to form long barrier rows with continuous advertising indicia placed either individually on each A-frame structure, or as part of an assembled advertising panel with indicia on one display frame visually connected to the next.

Movement of the portable A-frame panel, once setup, may be easily achieved by lifting retractable handles 14*a* & 14*b* within their slideable position retained in apertures on frame apex fold edge 22. These retractable handles 14*a* & 14*b* may simply be U-shaped wire handles with bends or hooks interior to the panel to prevent their removal. In the preferred embodiment, the handles are formed of 16 gauge galvanized metal and holes are drilled along frame apex fold edge 22 to accommodate the handles in a sliding extension or collapsing manner.

Advertising indicia 17*a* & 17*b* presented on front side display panel 16 and/or back side display panel 18 may be pre-printed onto the corrugated panels (see 17*a*) or may be secured to the surfaces (see 17*b*) using any of a variety of removeably adhesive materials. Hook and loop attachment type strips 19 may be secured to either or both front and back sides of the display panel to secure removable sheets 21 incorporating mating hook and loop attachment surfaces.

Figure 2:
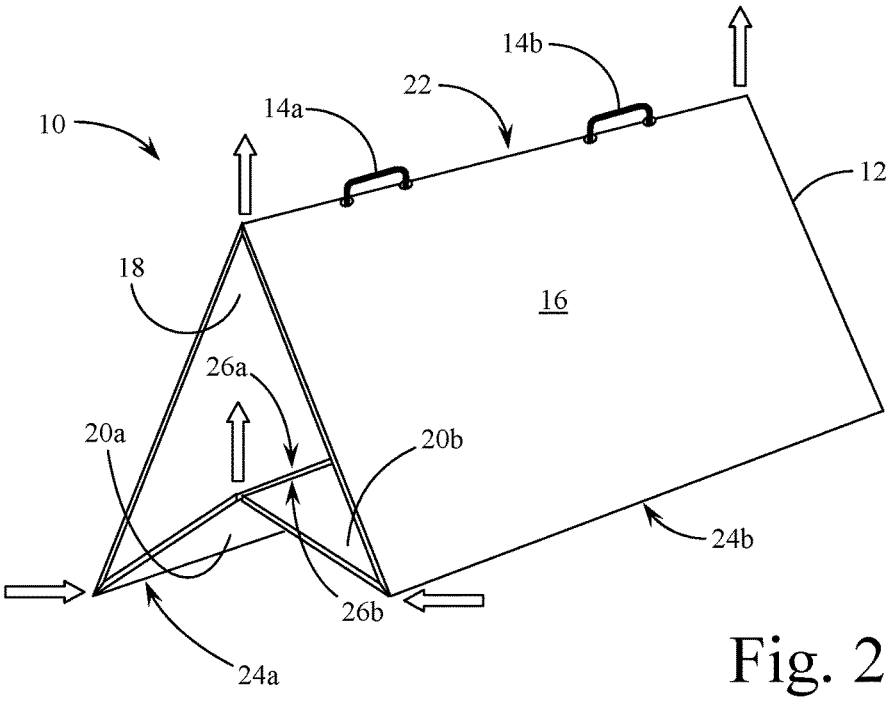
FIG. 2 is a perspective view of an assembled frame structure of the present invention undergoing a first method of collapse from the position shown in FIG. 1.
Figure 3:
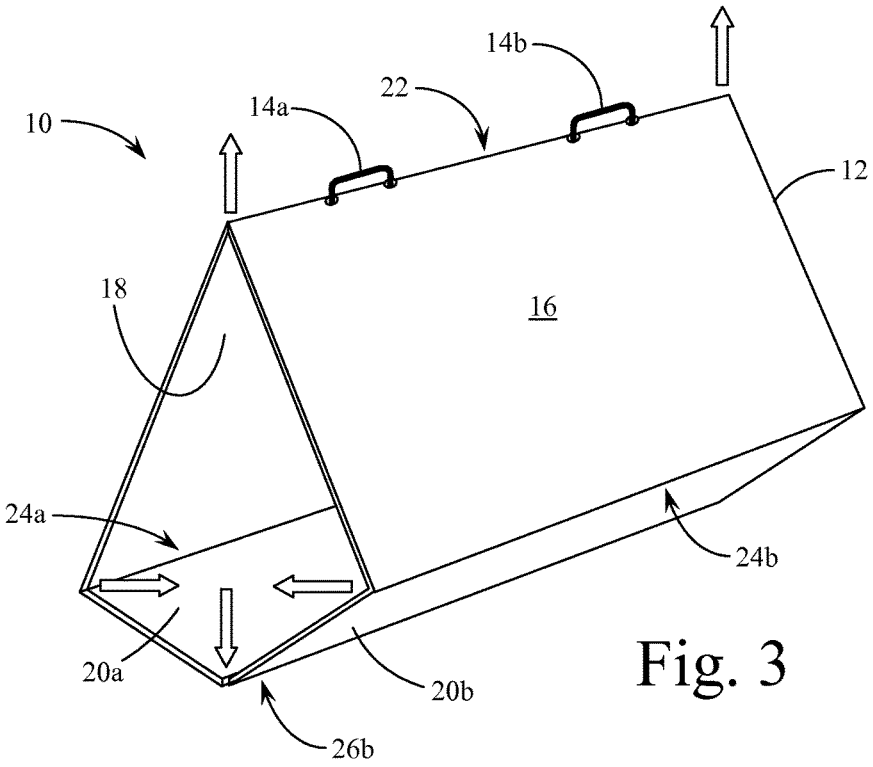
FIG. 3 is a perspective view of an assembled frame structure of the present invention undergoing a second method of collapse from the position shown in FIG. 1.

Folding the portable self-standing signage frame of the present invention may be accomplished in either of two methods shown in FIGS. 2 & 3. In FIG. 2 self-standing signage frame 10 is folded into a more compact configuration by drawing back base panel edge 26*a* and front base panel edge 26*b* upwards at the same time that frame apex fold edge 22 is drawn upwards (as indicated by arrows in FIG. 2). This draws frame back base fold edge 24*a* and frame front face fold edge 24*b* towards each other, collapsing front side display panel 16 against back side display panel 18 with back base panel 20*a* and front base panel 20*b* folded inside between the two display panels 16 & 18. This process of folding the panel maybe easily accomplished by lifting on retractable handles 14*a* & 14*b* and simultaneously lifting at a point between back base panel edge 26*a* and front base panel edge 26*b*. This method of folding results in a storable device that is generally flat with dimensions that of front side display panel 16 as shown.

Reference is next made to FIG. 3 for an alternate manner of folding the self-standing signage frame 10 of the present invention that, though it results in a larger configuration for storage, does result in a flatter configuration and one that can be lifted by the retractable handles without gravity opening the collapsed device up in the process. FIG. 3 shows self-standing signage frame 10 again being lifted by retractable handles 14*a* & 14*b* so as to draw front side display panel 16 against back side display panel 18 folding along frame apex fold edge 22. Back base panel 20*a* likewise folds against front base panel 20*b*, but this time back base panel edge 26*a* and front base panel edge 26*b* drop down and out from between the panels instead of being nested up between the panels. To the extent that gravity plays a part in folding the signage frame of the present invention, the method shown in FIG. 3 tends to be the more efficient method if the larger profile of the folded structure can be tolerated.

Figure 4:
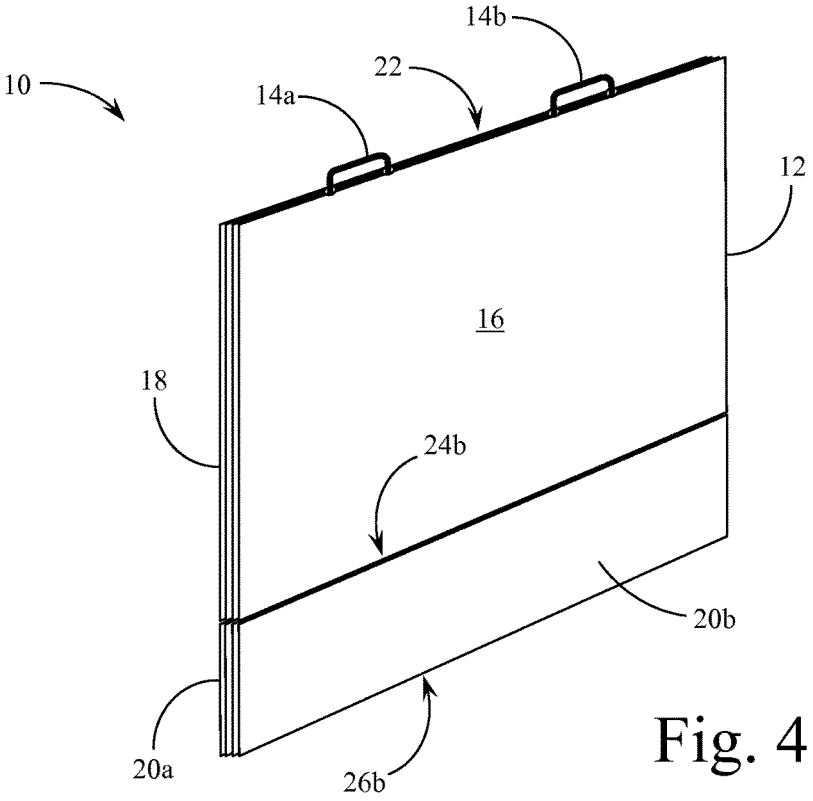
FIG. 4 is a perspective view of an assembled frame structure of the present invention after completion of the second method of collapse shown in FIG. 3.

The folded structure resulting from the method of collapsing shown in FIG. 3 is shown in FIG. 4. In this view, front side display panel 16 is shown fully collapsed against back side display panel 18 as back base panel 20*a* is shown fully collapsed against front base panel 20*b*. Once again, the collapsed configuration shown in FIG. 4, though larger in profile, does provide for a more efficient manner of rapidly collapsing the signage frame, as well as providing for flatter storage whereby multiple frames may be easily stacked one on top of the other in an entirely flat configuration.

Figure 5:
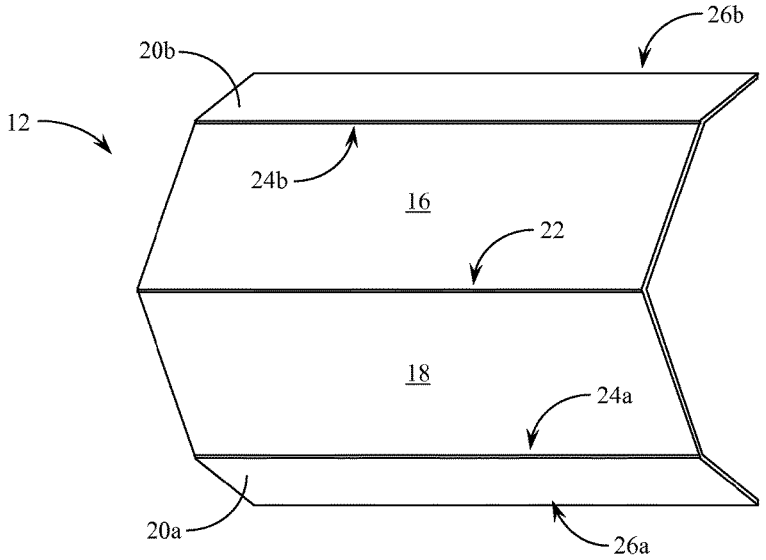
FIG. 5 is a perspective view of the corrugated panel component of the frame structure of the present invention.

FIG. 5 is a perspective view of the corrugated panel component 12 of the frame structure of the present invention, highlighting the score and fold lines associated with the initial construction and assembly of the A-frame barrier and signage display. As indicated above, the preferred embodiment of the present invention utilizes an 8'×8'×0.5" sheet of corrugated plastic material with three score/fold lines forming a total of four panel components. Frame back base fold edge 24*a* provides an initial score/fold line, while frame front base fold edge 24*b* provides a second score/fold line. Finally, frame apex fold edge 22 provides the third and middle score/fold line that allows the full construction of the A-frame barrier.

Once again, in the preferred embodiment, with an 8'×8' sheet of corrugated material, the triangular A-frame structure is established by creating three rectangular sides (two sides and a base) each 8' in length and 32" in width. The base of the structure is, of course, made up of two 16" wide panels (back base panel 20*a* and front base panel 20*b*) which come together to form the 32" wide base. Front side display panel 16 and back side display panel 18 are each 8' long and 32" wide in the preferred embodiment. Those skilled in the art will recognize that the dimensions described in the preferred embodiment are not critical to the structural integrity of the display panel and barrier and are simply dimensions readily attainable using available 8'×8' sheets of corrugated plastic material. Alternate embodiments 4' long instead of 8' long are anticipated, as are larger and smaller structures utilizing the same or similar length to width and height ratios of the preferred embodiment.

With any of the dimensions, the corrugated panel 12 utilized to construct the A-frame barrier is preferably scored (partially cut through its thickness along a score/fold line) on one side so as to permit the easy folding of the panel along a straight edge line. The direction of the corrugations are important for various methods of assembly and retention described in more detail below, but are otherwise not important as far as scoring and folding are concerned. Absent retention mechanisms described below, the panel may be scored and folded either with the corrugation channels or across the corrugation channels. Insofar as the basic structure of corrugated sheet material involves two flat surfaces with channels extending between them, either of the flat surfaces may be scored while the remaining flat surface remains intact to form a flexible hinge structure suitable for repeated folding and unfolding.

Figure 6A:
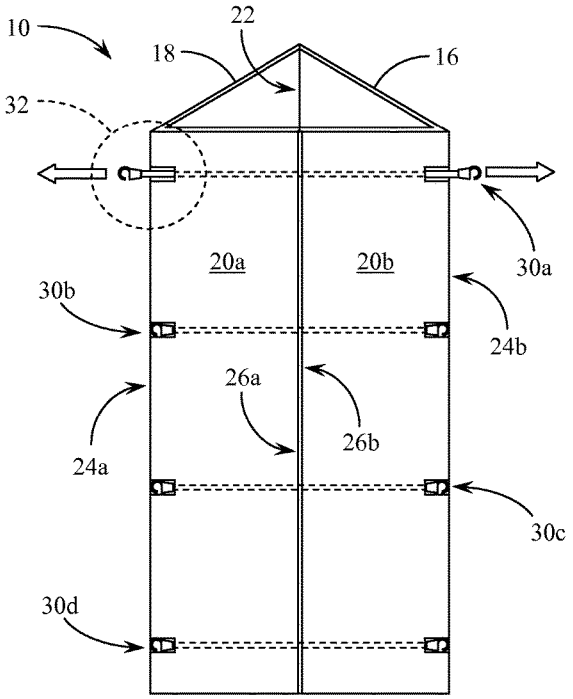
FIG. 6A is a bottom perspective view of an assembled and established frame structure of the present invention showing placement of elastic cord retention components.
Figure 6B:
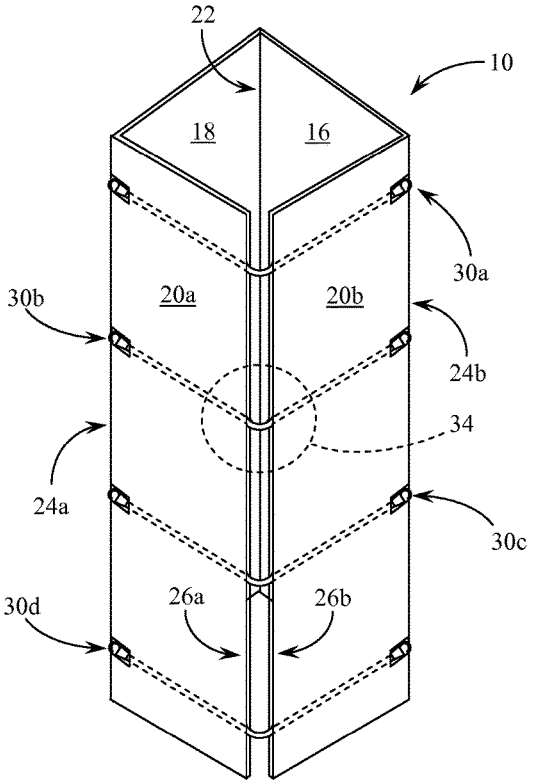
FIG. 6B is a bottom perspective view of an assembled frame structure of the present invention showing the elastic cord retention components as the frame is being collapsed.
Figure 7:
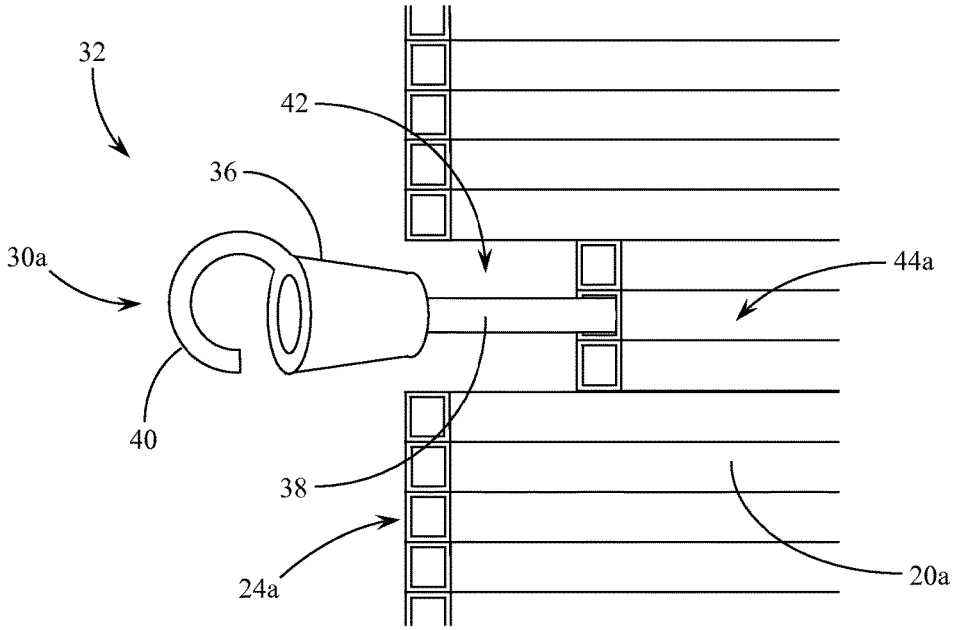
FIG. 7 is a detailed perspective view of the hook end structure of an elastic cord retention component of the present invention.
Figure 8:
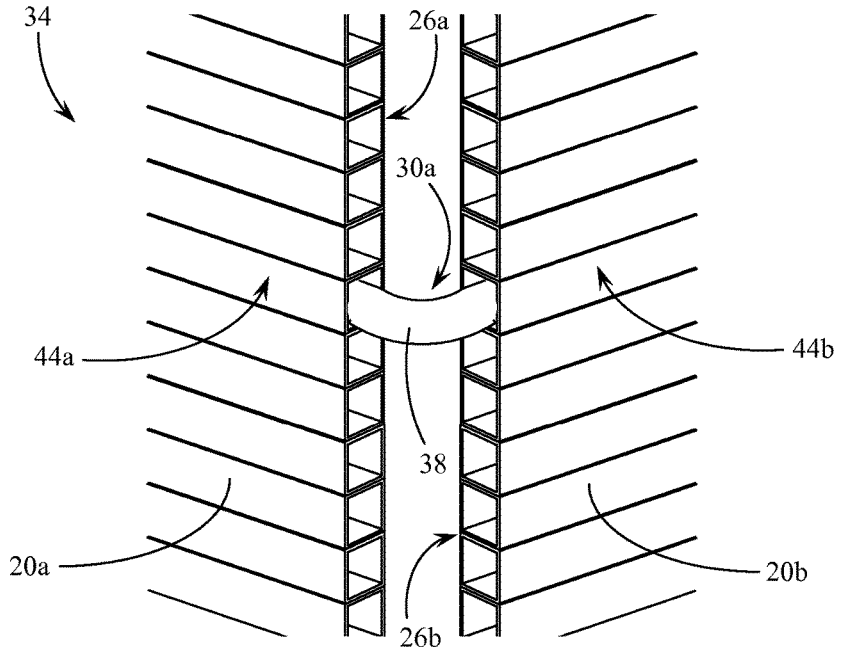
FIG. 8 is a detailed perspective view of the center hinge section of an elastic cord retention component of the present invention.

Reference is next made to FIGS. 6A & 6B as well as FIGS. 7 & 8 for a detailed description of a preferred manner of assembling and facilitating the secured setup of the display panel of the present invention utilizing stretchable shock cords or the like. FIGS. 6A & 6B are perspective views of the base of self-standing signage frame 10 with front side display panel 16 and back side display panel 18 shown only partially in each view. In the preferred embodiment shown in FIGS. 6A & 6B, elastic cord retention assemblies 30*a*-30*d* are shown fixed within and through back base panel 20*a* and front base panel 20*b*. The manner in which these elastic cords are threaded and positioned within the corrugated panels is described in more detail below with respect to FIGS. 7 & 8.

In the process of manufacturing and assembling the final product of the present invention, cut out notches are formed in each of back base panel 20*a* and front base panel 20*b* along frame back base fold edge 24*a* and frame front base fold edge 24*b*. These cut out notches (four along each edge in the embodiment shown in FIG. 6A) are large enough to receive the hook ends of an elastic cord that stretches through the corrugation channels of base panels 20*a* & 20*b* in a manner that joins the panels along back base panel edge 26*a* and front base panel edge 26*b*. These elastic cords thereby create a flexible hinge along base panel edges 26*a* & 26*b*. In addition, the elasticity of the cords allows for folding along this base center line and, with some tension established in each of the elastic cords, provides a means for automatically unfolding the display panel when collapsing pressure is released.

Elastic cord retention assemblies 30*a*-30*d* serve two purposes within the structure of the present invention. First, these elastic shock cords hold the overall frame together when it is positioned upright as shown in FIG. 1 above, and second, the cords act as a flexible hinge when folding for storage. This arrangement of elastic cords allows either the method of folding inward shown in FIG. 2 or the method of folding outward shown in FIG. 3. In addition, the elastic cord hooks attached to each end of the assemblies 30*a*-30*d* may be used to secure the established frame to ground stakes or weights for optional anchoring to the ground.

FIG. 7 is a detailed perspective view of a typical hook end structure of an elastic cord retention assembly 30*a* of the present invention. In FIG. 7, back base panel 20*a* (as an example) is shown along frame back base fold edge 24*a*. Elastic cord retention assembly 30*a* is shown positioned within back base panel 20*a* extending out from frame back base fold edge 24*a*. The end of elastic cord retention assembly 30*a* is generally made up of hook base and cord attachment 36 which secures the hook end to elastic cord 38. Extending from hook base and cord attachment 36 is open hook 40. Cut notch 42 is sized so as to allow for the hook end of elastic cord retention assembly 30*a* to be drawn into the notch in order to at least partially surround the hook end to prevent it from engaging unintentionally, as when the panel is being folded for storage. Back base panel 20*a* is shown to be constructed of many hollow corrugation tubes exemplified by hollow corrugation tube 44*a* through which elastic cord 38 extends. The size of elastic cord 38 is therefore defined in part by the size of the corrugated tubes from which the panel is constructed. In the preferred embodiment with a 0.5" thick panel, a 0.25" elastic cord easily fits within the corrugation tube as shown.

FIG. 8 is a detailed perspective view of the center hinge section of the assembled base panel of the A-frame barrier, showing the elastic cord retention assembly 30*a* bridging the gap between the two base panels 20*a* & 20*b* of the overall structure. In FIG. 8, back base panel 20*a* is shown adjacent to front base panel 20*b*. Back base panel edge 26*a* is aligned with and runs parallel to front base panel edge 26*b*. Elastic cord retention assembly 30*a*, comprising only elastic cord 38 in the view of FIG. 8, extends between the two base panels. Base back hollow corrugation tube 44*a* aligns with and extends the path of elastic cord 38 into base front hollow corrugation tube 44*b*.

In the preferred embodiment shown in FIGS. 6A & 6B four such elastic cord retention assemblies 30*a*-30*d* are utilized to appropriately secure and adequately structure the assembled self-standing signage frame 10 of the present invention. The process of manufacturing the overall product involves threading elastic cord through the various corrugated tube sections as shown and then securing the hook ends of the elastic cord retention assemblies in place. Once assembled in this manner, the overall frame structure may again be folded by directing the base panels either inward or outward as shown in FIGS. 2 & 3.

Although the present invention has been described in terms of the foregoing preferred embodiments, this description has been provided by way of explanation only, and is not intended to be construed as a limitation of the invention. Those skilled in the art will recognize modifications in the present invention that might accommodate specific barrier and display presentation environments and systems. Such modifications as to structure, size, and even the specific arrangement of components, where such modifications are coincidental to the environment or the specific subject matter being displayed, do not necessarily depart from the spirit and scope of the invention.

We claim:

1. A portable and collapsible A-frame barrier and display panel comprising:

a sheet of corrugated material, the sheet scored and folded on at least three parallel lines, the folded sheet form two side panels and two base panel halves, the base panel halves having separate edges that, when the sheet is folded, are parallel and meet to form a two-part base panel;

a plurality of elastic cords stretched laterally across the two base panel halves, drawing the separate edges thereof together to maintain the base panel with an elastic hinged center line; and at least one handle positioned on and extending from apertures in a fold line between the two side panels;

wherein when the base is placed on a flat surface the folded sheet of corrugated material forms the A-frame structure with the side panels forming an apex edge along the fold line between the side panels.

2. The barrier and display panel of claim 1 wherein the elastic cords further comprise hook ends and the two base panel halves further comprise cut-out notches within which the hook ends of the elastic cords may be retained.

3. The harrier and display panel of claim 1 wherein the sheet of corrugated material comprises a sheet of corrugated plastic.

4. The barrier and display panel of claim 1 wherein the elastic cords are each threaded through corrugation channels of the base panel halves.

5. The barrier and display panel of claim 1 wherein at least one of the two side panels incorporates printed indicia thereon.

6. The barrier and display panel of claim 1 wherein at least one of the two side panels further comprises a removable attachment surface for the placement and positioning of at least one removable display panel thereon, the at least one removable display panel incorporating printed indicia thereon.

* * * * *